United States Patent [19]

Grick et al.

[11] 4,432,099

[45] Feb. 21, 1984

[54] INDIVIDUALLY FITTED HELMET LINER

[75] Inventors: Shelly J. Grick, Jermyn; Joseph A. Beautz, Forest City, both of Pa.

[73] Assignee: Gentex Corporation, Carbondale, Pa.

[21] Appl. No.: 396,777

[22] Filed: Jul. 9, 1982

[51] Int. Cl.[3] ..... A42B 3/02

[52] U.S. Cl. ..... 2/412; 2/414; 2/417

[58] Field of Search ..... 2/412, 411, 414, 413, 2/417, 418, 419, 420, 6, 10

[56] References Cited

U.S. PATENT DOCUMENTS

| | | | |
|---|---|---|---|
| 3,344,433 | 10/1967 | Stapenhill | 2/420 |
| 3,425,061 | 2/1969 | Webb | 2/414 |

FOREIGN PATENT DOCUMENTS

| | | | |
|---|---|---|---|
| 2504849 | 5/1974 | Fed. Rep. of Germany | 2/411 |
| 2370448 | 6/1978 | France | 2/412 |
| 7900886 | 11/1979 | Switzerland | 2/417 |
| 1578351 | 11/1980 | United Kingdom | 2/412 |

*Primary Examiner*—Peter P. Nerbun

*Attorney, Agent, or Firm*—Shenier & O'Connor

[57] ABSTRACT

An individually fitted helmet liner includes a plurality of superposed contacting layers, each of which consists of a thermoplastic sheet formed with an array of pockets which are open and unfilled to allow their deformation in response to compressive contact with an adjacent layer. The liner is fitted to an individual wearer's head by heating the sheets to a plastic state, placing the liner between an outer shell and the wearer's head, and pressing down on the outer shell to deform the sheets to the proper extent.

6 Claims, 4 Drawing Figures

INDIVIDUALLY FITTED HELMET LINER

BACKGROUND OF THE INVENTION

Protective helmets having hard outer shells for use in various military, industrial or other applications are well known in the art. In such helmets, it is generally desirable to provide a resilient liner assembly between the outer shell and the wearer's head to help absorb shock. While straps or similar elements have customarily been used in the past for this purpose, they must be adjustable to accomodate various head sizes, resulting in some wobbling from front to back or from side to side.

Various proposals for custom-fitted liner assemblies have been suggested in an attempt to overcome this defect. According to one known method of making a custom-fitted helmet, disclosed in Morton U.S. Pat. No. 3,882,546, the outer helmet shell is spaced a suitable distance from the wearer's head and foam is injected into the region between the outer shell and an elastic layer closely overlying the wearer's head. The necessity of directly handling the foaming agent limits the utility of this method in the field.

According to another method of making a custom-fitted helmet, disclosed in Chisum U.S. Pat. No. 4,100,320, the helmet liner is preformed with a plurality of adjacent pairs of cells respectively containing the first and second components of a foamable mixture. After the liner is placed between the helmet shell and the wearer's head, the cell partitions separating the first and second components are removed to initiate the foaming process. While this method avoids direct exposure to the liner foam, the complexity and hence expense of the preformed liner limit its practical application. Both of those methods, moreover, are one-shot procedures in that they do not permit subsequent adjustment of the liner to accommodate a different wearer or a changed head size.

Yet another method is disclosed in the commonly assigned application of Michael R. Lavender, Ser. No. 132,817, filed Mar. 24, 1980, now abandoned in favor of continuation application Ser. No. 382,420, filed May 27, 1982. That application discloses an individually fitted helmet liner having a plurality of layers, each of which consists of a thermoplastic sheet formed with an array of pockets which individually receive hollow epoxy balloon spacer elements. Adjacent layers are arranged with the spacer elements of one layer in register with the spaces between the elements of an adjacent layer, so that the layers nestle together to an extent determined by the degree to which the sheets are permanently deformed in the regions of the spheres of adjacent layers. The sheets making up the liner are elastic at normal temperatures but are plastically deformable at elevated temperatures to permit custom fitting to a changed head size simply by fitting the helmet after heating the layers to a suitable softening temperature.

While the helmet liner described above fulfills the objects of its inventor, there remain certain areas for improvement. First, the necessity of arranging the adjacent layers with the spheres of one layer in register with the spaces between the spheres of an adjacent layer entails a relatively expensive and time-consuming manufacturing step of maintaining the various layers in proper register. Second, the relative incompressibility of the hollow epoxy spheres results in a tendency of the completed helmet to shift its position relative to the wearer's head, owing to an inability of the liner to conform fully to the contours of the wearer's head. Finally, drawstrings or the like are required to maintain the sheets in tension during size adjustment.

SUMMARY OF THE INVENTION

One of the objects of our invention is to provide an individually fitted helmet liner which may be fitted to a wearer's head rapidly and in a simple manner.

Another object of our invention is to provide an individually fitted helmet liner which may be refitted to accommodate a changed head size.

Still another object of our invention is to provide an individually fitted helmet liner which has uniform and hence predictable structural characteristics.

A further object of our invention is to provide an individually fitted helmet liner which does not require trimming after fitting.

Still another object of our invention is to provide an individually fitted helmet liner which is relatively simple and inexpensive to manufacture.

A further object of our invention is to provide an individually fitted helmet liner which resists the tendency to shift position on the wearer's head.

A still further object of our invention is to provide an individually fitted helmet liner which does not have to be maintained in tension during size adjustment.

Other and further objects will be apparent from the following description.

In general, our invention contemplates a helmet liner in which a plurality of layers, each of which consists of an elastic thermoplastic sheet formed with an array of pockets, are arranged in superposed contacting relationship with one another, with the pockets being open and unfilled to allow their deformation in response to compressive contact with an adjacent layer. The liner is fitted to an individual wearer's head by heating the sheets to a plastic state, placing the liner between an outer fixture and the wearer's head to deform the sheets to the proper extent, and removing the liner from the wearer's head when the liner has cooled to a rigid, nonplastic state.

By leaving the liner pockets open and unfilled rather than filling them with relatively imcompressible spacer elements, we are able to provide a helmet liner which, while sufficiently rigid to provide the necessary spacing between the outer shell and the wearer's head, is nevertheless compliant enough to smooth out the effects of relative layer alignment. Thus, in contrast to the liner disclosed in application Ser. No. 132,817, the pockets of a given layer do not have to be maintained in register with the spaces between the pockets of an adjacent layer, and the manufacturing process can be therefore greatly simplified. Because of the increased bulk compliance of the assembled liner, our liner also conforms more readily to the contours of the wearer's head, minimizing the tendency for the outer helmet to shift in position. Finally, we have found that by having the liner pockets open and unfilled, we are able to eliminate the drawstrings used in the previous liner to maintain the liner in tension during size adjustment. Our liner, by contrast, need merely be maintained in compression during the fitting procedure to deform the layers to the proper extent.

BRIEF DESCRIPTION OF THE DRAWINGS

In the accompanying drawings to which reference is made in the instant specification and in which like reference characters are used to indicate like parts in the various views.

DESCRIPTION OF THE PREFERRED EMBODIMENT

Figure 1:
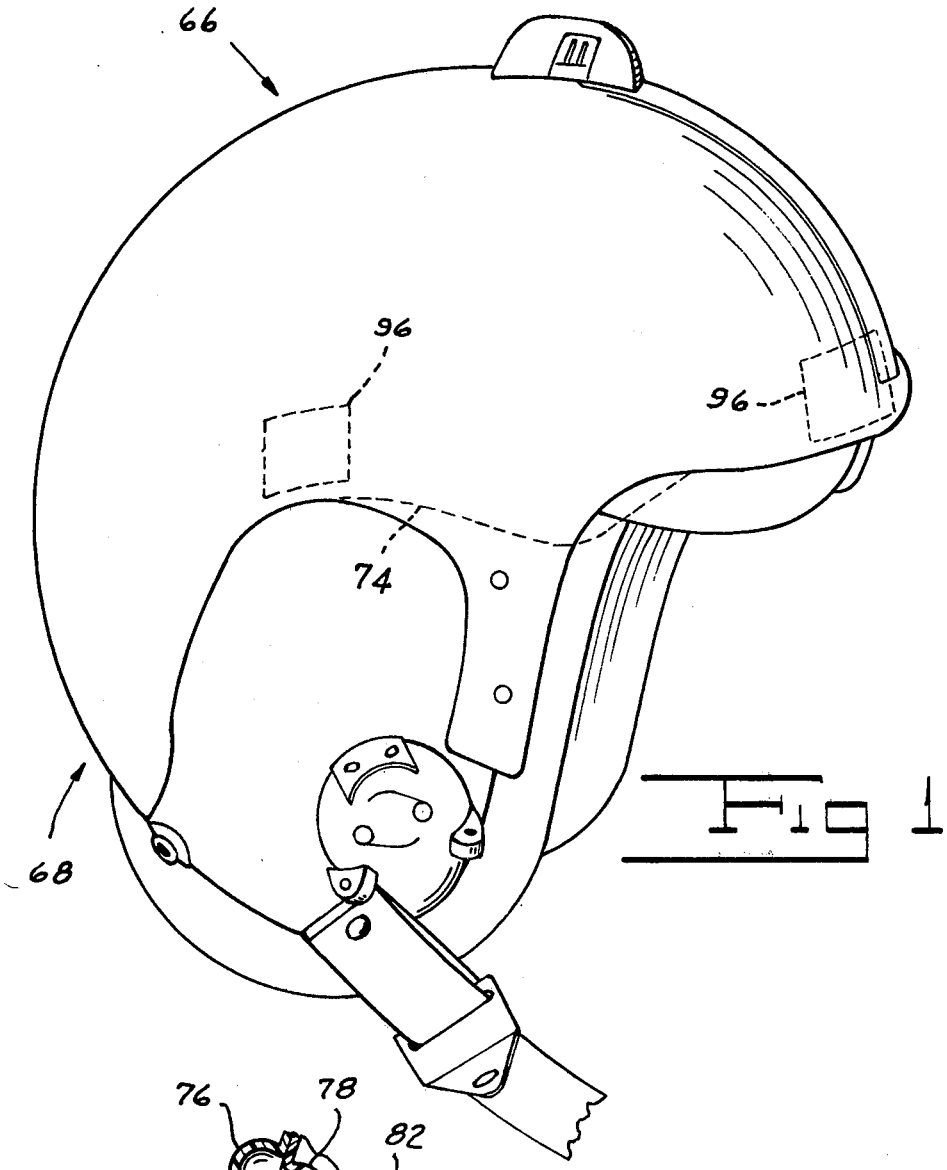
FIG. 1 is a perspective view of a helmet incorporating our individually fitted liner.

Referring first to FIG. 1, a preferred embodiment of our helmet, indicated generally by the reference numeral 66, includes an outer shell 68 and an inner thermoplastic liner 74. The shell 68 comprises a rigid outer layer 70, formed of a suitable reinforced plastic material, and an energy-absorbing polystyrene foam liner 72 carried inside the outer layer 70, as shown in FIG. 3.

Figure 2:
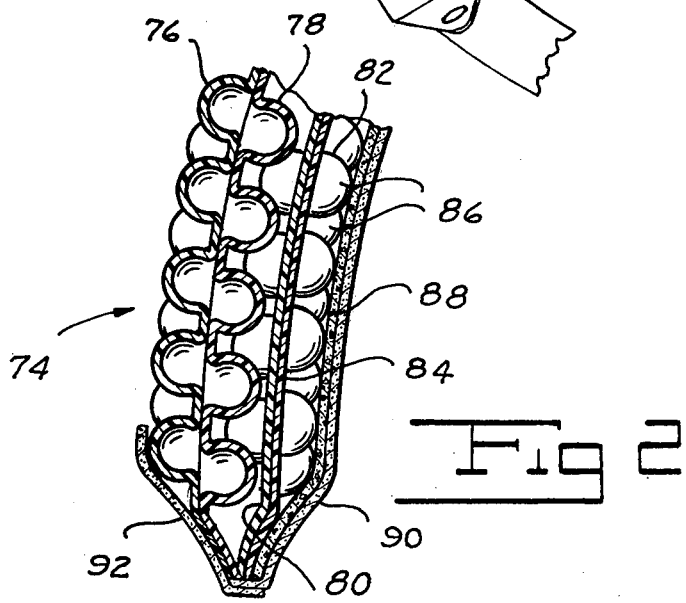
FIG. 2 is an enlarged fragmentary section of a peripheral portion of the liner of the helmet shown in FIG. 1.
Figure 3:
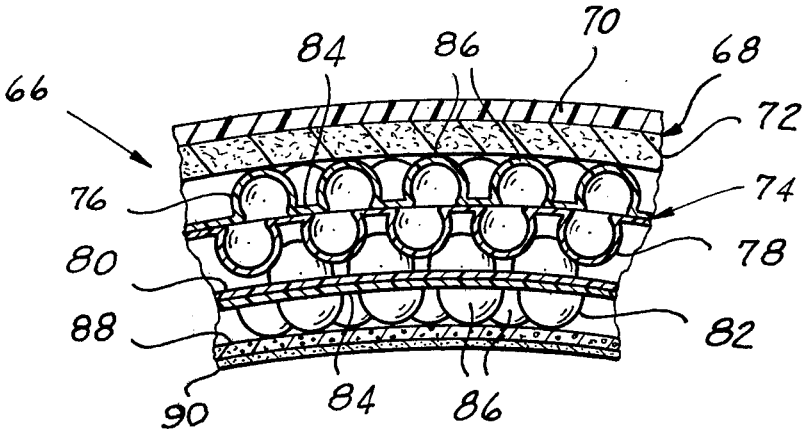
FIG. 3 is an enlarged fragmentary section of a central portion of our helmet, showing the relative arrangement of the outer shell and the thermoplastic liner.
Figure 4:
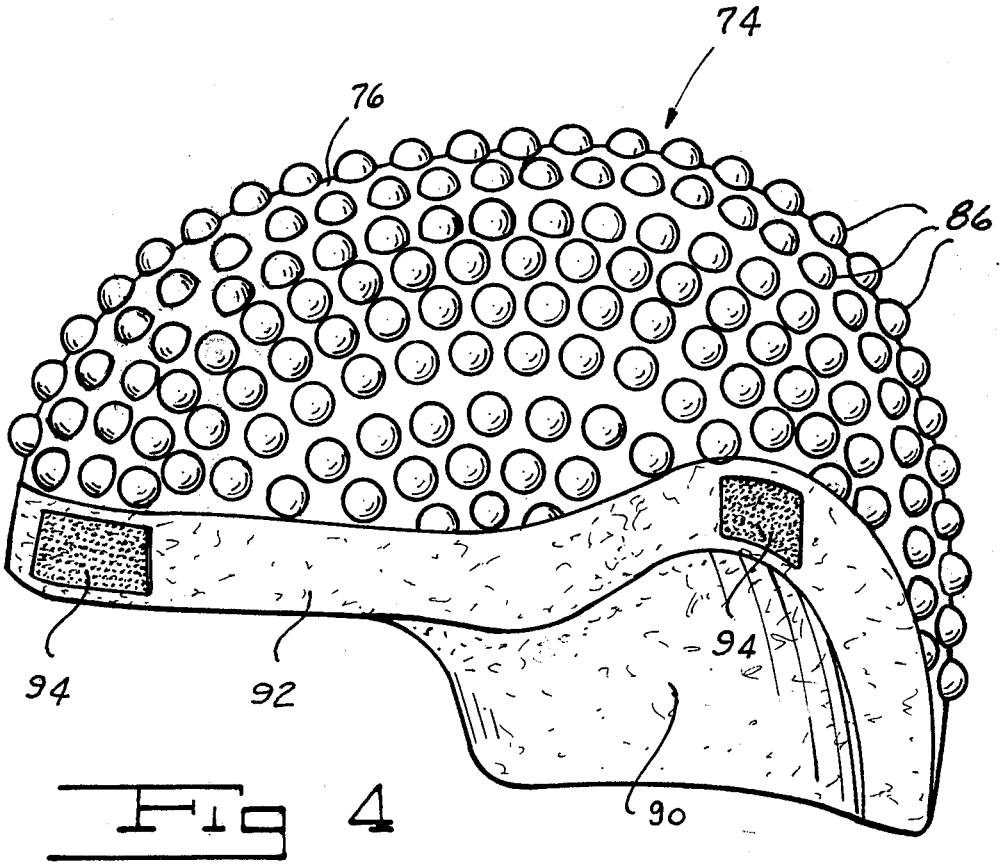
FIG. 4 is a perspective view of the inner thermoplastic liner of the helmet shown fragmentarily in FIG. 3.

Referring now also to FIGS. 2 to 4, inner liner 74, which is releasably secured to the shell 68 by any suitable means, such as the means to be described, comprises foursheet layers 76, 78, 80 and 82, formed of a suitable elastic thermoplastic material. Suitable thermoplastic materials include ethylene-vinyl acetate, a copolymer resin available from E. I. du Pont de Nemours & Company under the trademark "Elvax", and the copolymer of ethylene and methacrylic acid available from the same source under the trademark "Surlyn"; the latter material is an ionomer resin. Each of the layers 76, 78, 80 and 82 is a vacuum-formed over a hemispherical dome (not shown) similar to the mold shown in application Ser. No. 132,817, but with bumps or protuberances formed at regular intervals across the surface of the dome so that the resulting vacuum-formed sheet comprises a flat portion 84 with regularly spaced hollow spherical protuberances 86. Preferably, a larger-diameter dome is used to vacuum-form outer layers 76 and 78, while a smaller-diameter dome is used to form the inner layers 80 and 82. Layers 76, 78, 80 and 82 are arranged as shown in FIG. 3, with the flat portions of layers 76 and 78 and of layers 80 and 82 in contact with each other. In contrast to the helmet assembly shown in that earlier application, the protuberances 86 of layers 78 and 80 need not interdigitate with each other, the compliance of the unfilled protuberances 86 being sufficient in itself to afford the necessary accommodation between layers 78 and 80.

After layers 76, 78, 80 and 82 are vacuum-formed in the manner described above, they are trimmed to the required shape and their edges glued or otherwise secured together as shown in FIG. 2. A hemispherically patterned layer 88 of comfort foam is then glued along the inside edge of inner thermoplastic layer 82. A sewn knit fabric inner lining or cover 90 with a woven fabric outer peripheral band or edging 92 is then attached to the assembly of layers 76 to 88 by gluing the peripheral band 92 to the outside surface of the layer assembly about one inch up from the trimmed lower edge, as also shown in FIG. 2, so that the lining 90 covers the inner surface of foam layer 88 and band 92 extends along the periphery of outer thermoplastic layer 76. Peripheral band 92 carries front, rear and side fasteners 94 which mate with complementary fasteners 96 (FIG. 1) carried on the underside of the polystyrene foam liner 72 of the shell 68. Suitable such fasteners include, for example, the hook-and-loop fasteners sold by American Velcro, Inc., under the trademark "Velcro".

Preferably the overall inside dimensions of the liner 74 should not change more than about plus or minus ¼ inch when fitted to individual subjects. To accommodate a typical range of expected head sizes while maintaining this standard, we form the liner 74 in six basic sizes, using differently sized headforms, such as the headform shown in application Ser. No. 132,817, to determine the size and shape of the different layers during fabrication and assembly.

Adjacent thermoplastic layers 76, 78, 80 and 82 nestle together to an extent determined by the degree of permanent deformation of the sheets making up the layers. By deforming the sheets to the desired extent while in a plastic state and then cooling the sheets to cause them to set with that deformation, the effective thickness of the assembly of layers 76, 78, 80 and 82 may be readily adjusted within a particular sizing range.

To custom-fit the liner 74 to the head of the wearer, the liner is heated in an oven at 200° F. for about 7 to 10 minutes, the exact heating time and temperature depending on the particular thermoplastic used. After the liner has been heated in this manner, it is placed inside the shell 68 or a fitting fixture (not shown) by suitable alignment of the fasteners 94 with the corresponding fasteners 96 carried by the helmet or fixture. The shell 68 with the liner 74 inside is then placed on the individual's head and pressed firmly downward for about 3 minutes, or until the liner 74 has cooled to a temperature at which it has sufficiently solidified.

After the layers 76, 78, 80 and 82 cool to a rigid, nonplastic state, the sheets forming the layers retain their plastic deformation to provide the desired accommodation to the wearer's head. This procedure may be followed repeatedly to refit the liner 74 either to a different individual or to the same individual with a changed head size, so long as the new size is at least as large as the previous head size fitted and in the same size range. Thus, our liner readily accommodates size changes due, for example, to changed hair length or bumps on the head.

It will be seen that we have accomplished the objects of our invention. Our helmet liner is simple and inexpensive to manufacture, and may be fitted to a wearer's head rapidly and in a simple manner. Our helmet liner may be refitted to accommodate a changed head size, while resisting the tendency to shift position on the wearer's head. Our helmet liner does not require the use of drawstrings or the like during fitting or require trimming afterward.

It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. A helmet liner including in combination a plurality of layers conforming generally to the top of a wearer's head, said layers being assembled in superposed contacting relationship with one another and each comprising a sheet formed with generally spherical spaced pockets on at least one side thereof, said sheets being elastic at normal temperatures and plastically deformable at elevated temperatures to permit adjustment of the effective thickness of said liner, said pockets being open and unfilled to allow their deformation in response to compressive contact with an adjacent layer.

2. A helmet liner as in claim 1 in which said sheets comprise ethylene-vinyl acetate.

3. A helmet liner as in claim 1 in which said sheets comprise a copolymer of ethylene and methacrylic acid.

4. A helmet liner including in combination a plurality of layers conforming generally to the top of a wearer's head, said layers being assembled in superposed contacting relationship with one another and each comprising a sheet formed with spaced pockets on at least one side thereof, said sheets being elastic at normal temperatures and plastically deformable at elevated temperatures to permit adjustment of the effective thickness of said liner, said pockets being open and unfilled to allow their deformation in response to compressive contact with an adjacent layer.

5. A helmet liner including in combination a plurality of layers conforming generally to the top of a wearer's head, said layers being assembled in superposed contacting relationship with one another and each comprising a sheet formed with spaced pockets on at least one side thereof, said sheets comprising ethylene-vinyl acetate and being elastic at normal temperatures and plastically deformable at elevated temperatures to permit adjustment of the effective thickness of said liner, said pockets being open and unfilled to allow their deformation in response to compressive contact with an adjacent layer.

6. A helmet liner including in combination a plurality of layers conforming generally to the top of a wearer's head, said layers being assembled in superposed contacting relationship with one another and each comprising a sheet formed with spaced pockets on at least one side thereof, said sheets comprising a copolymer of ethylene and methacrylic acid and being elastic at normal teperatures and plastically deformable at elevated temperatures to permit adjustment of the effective thickness of said liner, said pockets being open and unfilled to allow their deformation in response to compressive contact with an adjacent layer.

* * * * *